US005774911A

United States Patent [19]

Stube et al.

[11] Patent Number: 5,774,911

[45] Date of Patent: Jul. 7, 1998

[54] SLATTED BASE FOR A BED

[75] Inventors: Andreas Stube, Rodersdorf; Wolfgang Leistner, Ettingen, both of Switzerland

[73] Assignee: Matra AG, Fluh, Switzerland

[21] Appl. No.: 836,183

[22] PCT Filed: Oct. 31, 1995

[86] PCT No.: PCT/CH95/00254

§ 371 Date: May 1, 1997

§ 102(e) Date: May 1, 1997

[87] PCT Pub. No.: WO96/14003

PCT Pub. Date: May 17, 1996

[30] Foreign Application Priority Data

Nov. 4, 1994 [EP] European Pat. Off. ..... 94810638

[51] Int. Cl.[6] ..... A47C 23/06

[52] U.S. Cl. ..... 5/236.1; 5/238

[58] Field of Search ..... 5/236.1, 237, 238, 5/239, 241, 242

[56] References Cited

U.S. PATENT DOCUMENTS 5,282,285 2/1994 de Gelis et al. ..... 5/237

FOREIGN PATENT DOCUMENTS

000539644 A1 5/1993 European Pat. Off. .

000563497 A1 10/1993 European Pat. Off. ..... 5/238

*Primary Examiner*—Alexander Grosz

*Attorney, Agent, or Firm*—Limbach & Limbach L.L.P.

[57] ABSTRACT

A slatted base for a bed having elastically deformable supporting slats which connect longitudinal supports with mutually spaced spring slats running transverse to the longitudinal supports. The spring slats collectively form a supporting surface for a mattress. The middle area of the supporting slat is more elastically deformable than the end areas to provide more sleeping comfort.

20 Claims, 5 Drawing Sheets

Fig. 8
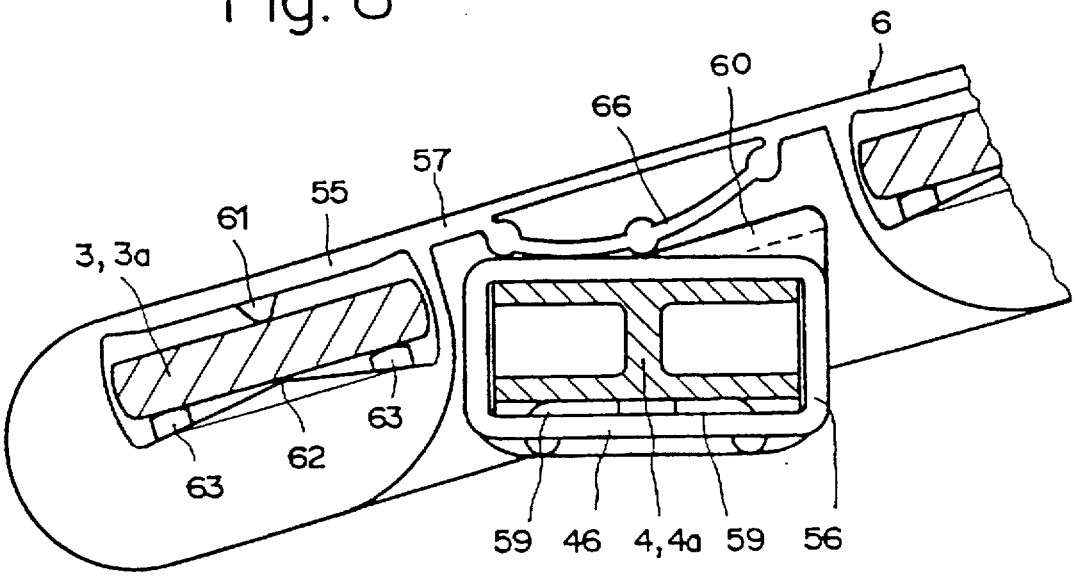
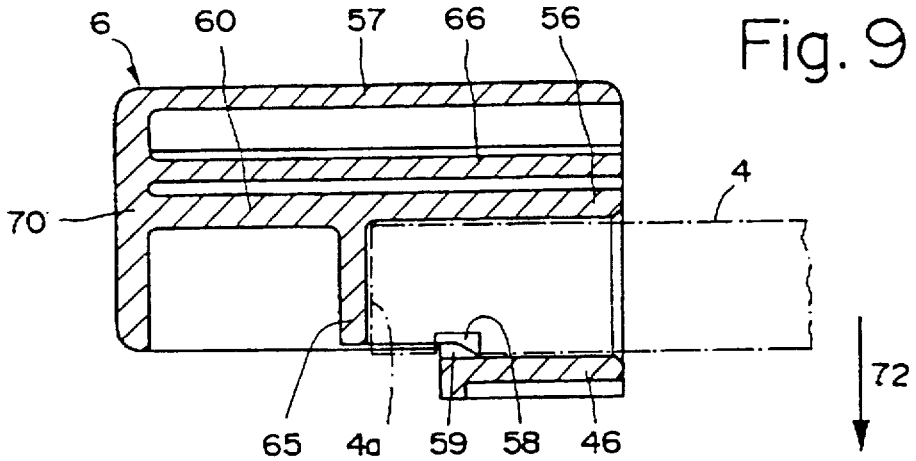
Fig. 9
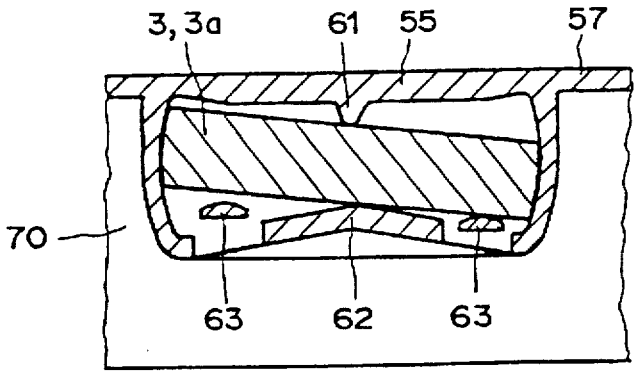
Fig. 10

SLATTED BASE FOR A BED

FIELD OF INVENTION

This invention relates to a slatted base for a bed with two longitudinal supports, spaced apart, running essentially in longitudinal direction of the bed, with a number of spring slats mutually spaced apart essentially in transverse direction with respect to the longitudinal supports, which collectively form a supporting surface for a mattress. Elastically deformable supporting slats situated lower with respect to the spring slats connect the spring slats with the longitudinal supports, the longitudinal supports being positioned below the spring slats and the outer sides of the longitudinal supports facing the ends of the spring slats being set back with respect to the spring slat ends. In each case, at least one spring slat and one supporting slat combine with two lateral edge-area elements to form a bearing module.

BACKGROUND OF THE INVENTION

A slatted base is disclosed in the European Patent Application EP 0 539 644. Shown therein are lower supporting elements, or respectively lower supporting slats, which are either firmly connected to the longitudinal supports or have a considerable degree of freedom at the places of connection to the longitudinal supports. It has been shown that the sleeping comfort achievable with the slatted base can be increased with specially designed supporting slats and with a corresponding fastening of the slots to the longitudinal supports. It is important for the lower supporting slat to have a certain elastic characteristic. It is also important to arrange the fastening of the supporting slats to the longitudinal supports in such a way that there is only a limited degree of freedom of the supporting slats with respect to the longitudinal supports.

Furthermore, the lateral connecting element, or the edge-area element as it will be denoted hereinafter, is of great significance. This edge-area element, which connects a lower supporting slat and one or more upper spring slats at each of their ends and combines them into a bearing module, is designed in such a way that a pivoting of each individual spring slat or a pivoting of all of the spring slats combined into a bearing module is possible transverse to the longitudinal direction of the longitudinal supports.

Resulting upon deflection of both the spring slats as well as the supporting slats are these longitudinal changes; these have to be compensated for, whether through the edge-area elements or the way of fastening the bearing module to the longitudinal supports.

With the present type of slatted bases, the longitudinal supports, which are hidden laterally below the spring slats, are not the dominating elements, which mark the appearance of the slatted base, but instead the edge-area elements, side by side in a row. So that the slatted base has an aesthetically appealing appearance, these edge-area elements should be as flat as possible, or respectively be constructed as low as possible, so that the lateral edge areas of the slatted base are finished off with a relatively slender line. Such a construction gives the viewer the impression of a freely suspended slatted base or bed.

SUMMARY OF THE INVENTION

It is the object of the present invention to create a slatted base, improved with respect to the state of the art.

The invention is an improvement in that the supporting slat has a central, elastically deformable area, situated between the longitudinal supports, which is more elastic than two end areas of the supporting slat directed from the longitudinal supports toward the spring slat ends. The supporting slat is supported on the two longitudinal supports and is held thereon with connecting elements. A pivoting movement of the supporting slat is possible at each supporting place in the transverse direction to the corresponding longitudinal support, wherein the pivoting movements have the effect that the two lateral edge areas of a bearing module, when loaded at any place, move from the support side downward.

The range of deflection of the spring slats in the middle of the slatted base is relatively large compared to the relatively weak deflection of the slatted base. This difference in deflection is obtained by means of areas of differing elasticity of the supporting slat. Too deep a sinking in of a person sifting down at the edge of the slatted base can thereby be prevented. Through the holding, especially the holding down, of the supporting slat on the longitudinal supports with connecting elements at the places where the supporting slat is supported on the former, and through the relatively highly elastic, deformable middle area of the supporting slat, the opposed pivoting movement is achieved at the places of support. This opposed pivoting movement is responsible for the opposite lateral slatted base edge not being lifted up, but being lowered in the direction of load, when the one lateral slatted base edge is loaded. The opposed pivoting movement thereby prevents a tilting of the slatted base, in the case of one-sided loading.

Each end area of a supporting slat has a limiting member which, in an unloaded state of the slatted base, is spaced apart in each case from the more closely situated longitudinal support so that a deflection, in particular of the edge areas of the slatted base, cannot take place to the point of destruction of a component, but instead is kept within reasonable limits. The maximal deflection of the edge area is preferably designed to be adjustable, with an adjustable setting member. Since a setting member is located on both sides of the slatted base for each bearing module, an individual setting of the maximal deflection of the bearing module is possible along the slatted base. The setting member enlarges or reduces an interim space between the limiting member and the more closely situated longitudinal support, which serves as a limit stop. The limiting member, with increasing deflection, then sooner or later comes to a stop at the setting member. The setting member is preferably made of an elastic, rubber material so that the deflection is not stopped abruptly, but is gently braked.

The placement of the supporting slat on the longitudinal supports is preferably with a support projection protruding from each supporting slat over the longitudinal supports. The projection can be essentially triangular in cross-section and can extend in the longitudinal direction of the longitudinal supports essentially over the entire width of the supporting slat A triangular point is thereby turned toward the longitudinal supports. By means of the connecting elements, in particular the holding-down elements, acting upon the supporting slat, the support projections are each held down on the longitudinal supports. A lifting off of the supporting slat from the longitudinal supports is thereby impossible. On the other hand, a pivoting of the supporting slat at the support places about the support point of the support projection is possible. The holding-down elements are designed in such a way that necessary compensations in length of the supporting slat upon deflection of its middle area can be made, with a changing load of the slatted base.

A support element made of an elastic material is preferably provided between the support projections and the longitudinal supports. In this way, deflection noises can be prevented and the aforementioned movement possibilities of the supporting slat at the places of contact, relative to the longitudinal supports, are already provided by means of the elastic support. The support element is preferably made of a relatively soft rubber or silicon material or the like, and has a notch into which the aforementioned support projection of the supporting slat is led. The support element rests, with a plate-shaped layer, on the longitudinal support.

The spring slats of the slatted base, in an unloaded state, are slightly raised in the middle. They have an upwardly protruding deflection curve. Upon loading of the slatted base, the spring slats deflect downward and attain a downward, sagging bend. The middle area of the supporting slat is preferably designed in such a way that it is bent concavely relative to the unloaded spring slats. The curve of the bend of the supporting slats is preferably designed such that it corresponds to that of the correspondingly loaded, downwardly deflected spring slats. The supporting slat, thus bent, does not disturb the relatively large range of deflection of the spring slats. It however limits the maximal range of deflection without creating an essentially hard, punctual limitation spot directed toward the mattress.

Seen as a whole, the supporting slat is also pre-bent, preferably concavely, with respect to the spring slats. The supporting slat can, however, be of an undulating design.

According to their manufacture, the supporting slat ends have a stretch of at least 5 cm which runs straight. In this way, it is possible to adjust a supporting slat to a limited range of differing slatted base widths by shortening these ends. The direction of insertion of the supporting slat ends into the edge-area elements remains the same after the shortening.

The supporting slats are manufactured as injection-molded parts, preferably of a thermoplastic material. The limiting member can be integrated into the supporting slat. To avoid material accumulations, a ribbed construction is usually necessary. It is also possible to manufacture the supporting slats according to a so-called gas internal pressure process. An injection-molded hollow body is thereby generated, which has an outer surface without ribs, which helps prevent accumulation of layers of dust.

Each edge-area element has essentially pocket-shaped holding means for the end of the spring slat and for the end of the supporting slat of a bearing module. The holding means are positioned side by side in the longitudinal direction of the longitudinal supports and do not overlap in this direction. A cover wall, designed as a bearing element, spanning all holding means, is provided which connects the holding means together tensionally.

By means of this construction, an edge-area element is created, which has an extremely slender construction, since the holding means for all slat ends are positioned side by side.

The edge-area elements are intended to accept and hold all slat ends facing each other which form a bearing module. One of the slats is a lower-situated supporting slat, and at least one is a higher-situated spring slat. Preferred embodiments have bearing modules with two spring slats positioned next to each other, the lower-situated supporting slat being positioned between the two spring slats. Also located at the edge areas at the head and at the foot of the slatted base are edge-area elements in which three spring slats, positioned side by side, can be used, the lower-situated supporting slat being positioned in one of the two interim spaces between the spring slats.

The edge-area element may be slipped onto the spring slat ends and supporting slat ends facing each other. Due to the construction, in which the edge-area element is not connected to any longitudinal groove, it is necessary to provide means to prevent a lateral slipping off of an edge-area element from the slat ends. According to the invention, securing means are provided which are designed as a type of snap device. A notch can be cut into one of the slat ends, preferably in the end of the supporting slat, the notch running transversely to the supporting slat, into which notch a rib engages, which is disposed on the holding means of the edge-area element for the supporting slat.

The holding means for the supporting slat, which, like the holding means for the spring slat, is pocket-shaped, is connected to the cover wall of the edge-area element via a member which can be stressed upon torsion and bending. The connecting member may be tongue-shaped. It serves the purpose of allowing the edge-area element to be pivoted with respect to the supporting slat in the longitudinal direction of the slatted base. The spring slats inserted in the corresponding edge-area element are also pivotable with respect to the longitudinal supports. Provided between the cover wall of the edge-area element and the holding means for the supporting slat end is a pivot limit stop of circular cross-section about which the holding means for the supporting slat can roll upon pivoting of the edge-area element.

Each holding means for one of the spring slats, which is preferably designed as a pocket surrounding the end of the spring slat, is designed in such a way that the spring slat may be tilted therein, within limits, transversely to its longitudinal direction. This can be achieved, for example, in that projections are provided inside the pocket running in the longitudinal direction of the spring slat, pressing upon the middle of the spring slat, about which projections the spring slat is tiltable on both sides until it abuts the limit stops. Spring elements in the form of flexible tongues inside the pocket-shaped holding means press upon the lateral edge areas of a spring slat end inserted in the holding means, so that this can be held in an untilted position in an unstressed state. This gives an uncovered slatted base an aesthetically appealing appearance in that the spring slats are all directed toward each other in an untilted position.

The aforementioned, multiple tilting possibilities ensure that the spring slats adapt optimally to the body contours of a person lying on the bed.

The holding means, in particular those which do not have the aforementioned securing means, can be provided with a stop which is designed in such a way that, in the unloaded state of the slatted base, the end of the associated slats reaches essentially to the stop. The slatted base can therefore be lifted on the lateral edge areas without significant upward deflection of the correspondingly grasped bearing module.

The edge-area element is preferably manufactured in one piece of a thermoplastic material. This gives the edge-area element the stability necessary for this type of slatted base.

An edge-area element has essentially pocket-shaped holding means for the end of the spring slat and for the end of the supporting slat of a bearing module. All holding means are positioned side by side in the longitudinal direction of the longitudinal supports of the slatted base and not overlapping in this direction. A cover wall that is designed as a bearing element spanning all holding means being provided, which connects the holding means together tensionally, can also be used on a slatted base according to the state of the art as described in the introduction. Likewise the connecting member, which can be stressed upon torsion and bending, and via which the holding means for the supporting slat is connected to the edge-area element, is not limited to use together with edge-area elements with holding means positioned side by side.

BRIEF DESCRIPTION OF THE DRAWINGS

The invention will be better understood by reference to the attached figures in which:

FIG. 8 is a partial depiction of an edge-area element according to FIG. 6, the edge-area element being drawn in a shown position relative to the supporting slat;

FIG. 9 is a section along the line IX—IX in FIG. 7, in which the fastening of the holding means for the supporting slat is visible on the edge-area element; and FIG. 10 is a section along the line X—X in FIG. 7, showing a spring slat end in a tilted position in a pocket-shaped holding means of the edge-area element.

DESCRIPTION OF THE PREFERRED EMBODIMENT

Figure 1:
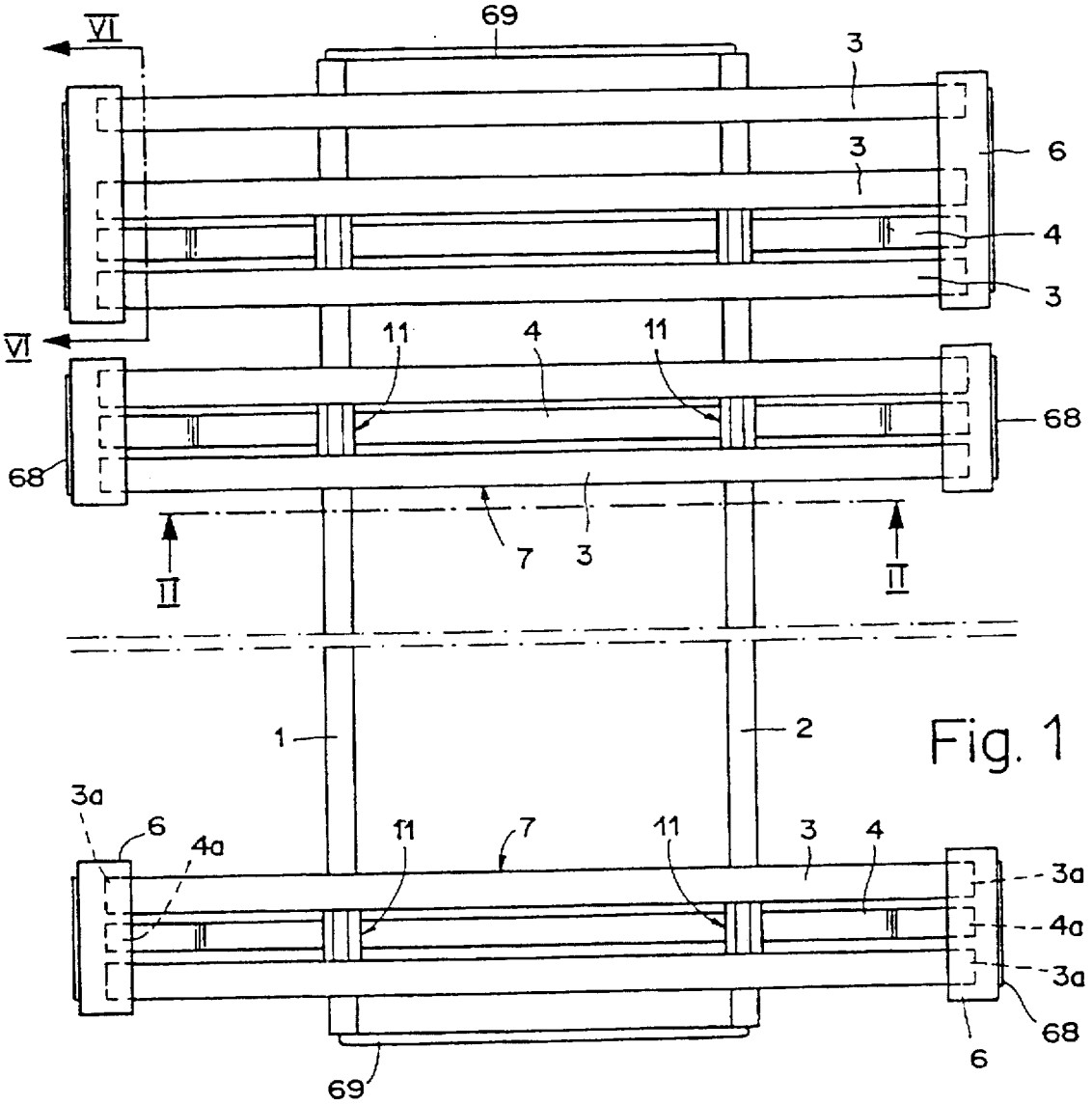
FIG. 1 is a top view of a slatted base according to the invention.
Figure 2:
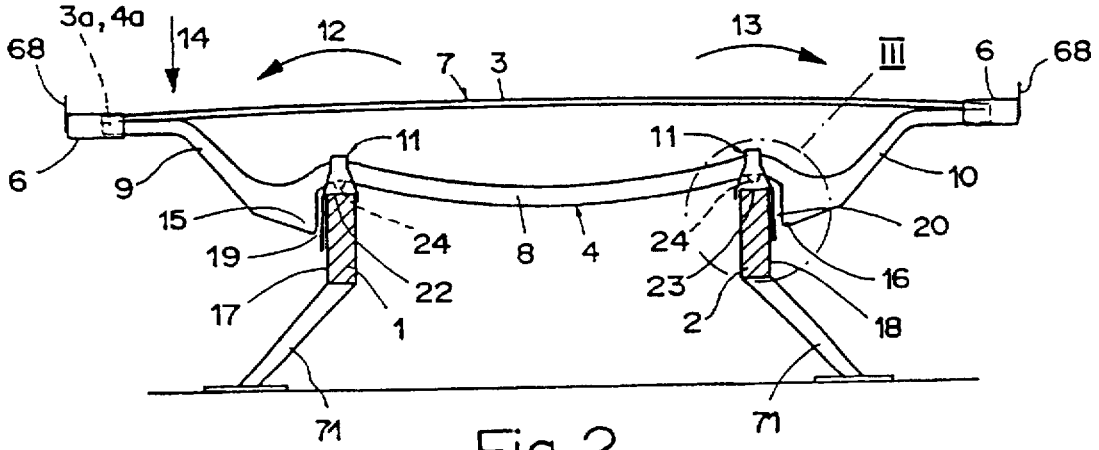
FIG. 2 is a cross-sectional view of the slatted base according to FIG. 1 along the line II—II.

Shown in FIG. 1 is a preferred embodiment example of the slatted base seen from above. FIG. 2 shows a section along the line II—II in FIG. 1, and shows a side view of a bearing module 7 of the slatted base. Each bearing module 7 has two or three upper spring slats 3 and a lower supporting slat 4, where the slats extend transversely with respect to the longitudinal supports 1, 2, which run below the slats. The ends 3*a*, 4*a*, facing each other, of all slats 3, 4, which form a bearing module 7, are held in an edge-area element 6.

The bearing modules 7 are positioned in a row along the longitudinal supports 1, 2, which are spaced apart from each other and which usually run parallel to each other. The spring slats 3, lying side by side, of all the bearing modules, form a supporting surface for a mattress to be placed on the slatted base.

The supporting slat 4 of each bearing module 7 is intended to hold the latter firmly on the longitudinal supports 1, 2.

The slatted base construction is of the kind that the longitudinal supports 1, 2 run under the spring slats 3 and are set back laterally from the spring slat ends 3*a* toward the middle of the slatted base. Outwardly projecting supporting feet 71 can be fastened to the longitudinal supports 1, 2 at both the head and foot of the slatted base, or there can be a bearing angle intended for insertion of the slatted base into a bed frame. In the construction with supporting feet 71, without bed frame, the longitudinal supports 1, 2 are not visible to an observer from the side, and the slatted base gives the impression of suspended spring slats 3, which are limited laterally by the edge-area elements 6.

In the unloaded state, the spring slats 3 are bent slightly upward, i.e. away from the longitudinal supports 1, 2. The supporting slat 4, lower with respect to the spring slats 3, has, on the whole, a concave curvature, relative to the spring slats 3. The supporting slat 4 has an undulating design. The supporting slat 4 is subdivided into essentially three parts. A middle part 8, extends from longitudinal support 1 to longitudinal support 2 and is designed to be elastically deformable. Adjacent to the middle area, each supporting slat 4 has one end area 9, 10 each, extending outwardly from the longitudinal supports 1, 2. Each supporting slat 4 has an outer end 4*a* which is turned toward the ends 3*a* of the higher-situated spring slat 3 and terminates in an edge-area element 6. Provided over the longitudinal supports 1, 2, for each supporting slat 4, are connecting elements, or holding-down elements 11, which hold, or hold down, the supporting slats 4 on the longitudinal supports 1, 2, not rigidly, but in such a way that compensations in length during deflection of the supporting slat 4, or respectively of the spring slats 3, are possible relative to the longitudinal supports 1, 2, and that a pivoting movement of the supporting slat 4 in transverse direction to the longitudinal support 1,2 is possible at each place of contact of the supporting slat 4 on the longitudinal supports 1, 2.

Achieved through the specially conceived connection of the supporting slat 4 to the longitudinal supports 1, 2 with the holding-down elements 11 as aforementioned, and through the elastically deformable middle area 8 of the supporting slat 4, is that with the loading of the spring slats 3 at the support places of the support slat 4 on the longitudinal supports 1, 2, a pivot movement in counter direction takes place; i.e., with each loading of the slatted base, the edge-area elements 6 move downward on both sides of a bearing module 7. This is not only the case when loading of the slatted base takes place in the middle, but it is also the case when only one lateral edge of the slatted base is loaded. A slanted position of the mattress is thereby avoided, and the tilting effect, known until now, does not occur.

In order to give the edge area of the slatted base the necessary stability and in order not to make the range of deflection there excessively large, the two end areas 9, 10 of the supporting slat 4 have been designed to be less elastically deformable than the middle area 8 of the supporting slat 4.

Indicated by the arrow 14 in FIG. 2 is a loading of just the one lateral edge of the slatted base. Indicated by the arrows 12 and 13 are the pivoting directions at the places of support of the supporting slat 4 on the longitudinal supports 1, 2. Indicated by the arrows 12, 13, 14 are the direction of movement of the edge-area elements 6 with increased loading.

In each end area 9, 10 of a supporting slat 4, a limiting member 15, 16 is provided near the outer side 17, 18 of each longitudinal support 1, 2. The left and the right limiting members 15, 16 extend downward on said outer side of the longitudinal supports over a certain partial area of the latter, a stop face being formed on each limiting member, where the face runs parallel to the outer side of the corresponding longitudinal support 1, 2. In the unloaded state of the corresponding bearing module 7 one interim space 19, 20 each is present between said stop face of the limiting members 15, 16 and said outer sides 17, 18 of the longitudinal supports 1, 2. Upon loading of the corresponding bearing module 7, the limiting members 15, 16 move with their stop faces, as a result of the previously described pivoting of the supporting slat supports, toward the outer sides 17, 18 of the longitudinal supports 1, 2, and, after a certain deflection of the spring slats 3 and of the edge-area elements 6, come to rest on the outer sides of the longitudinal supports 1, 2. Since now a further pivoting of the supporting slat 4 about its support places is no longer possible, the range of deflection is thereby limited. Depending on the size of the interim space 19, 20 selected, the range of deflection, especially of the edge-area elements 6, is larger or smaller.

Fastening devices are located on the edge area element 6 so that holder parts, connecting parts or other parts can be fastened thereon.

Provided in the embodiment shown, for example, are holder pieces 68, which prevent a lateral slipping off of a mattress lying on the slatted base.

Head and foot-side holders 69 can prevent a longitudinal shift of a mattress on the slatted base.

Figure 3:
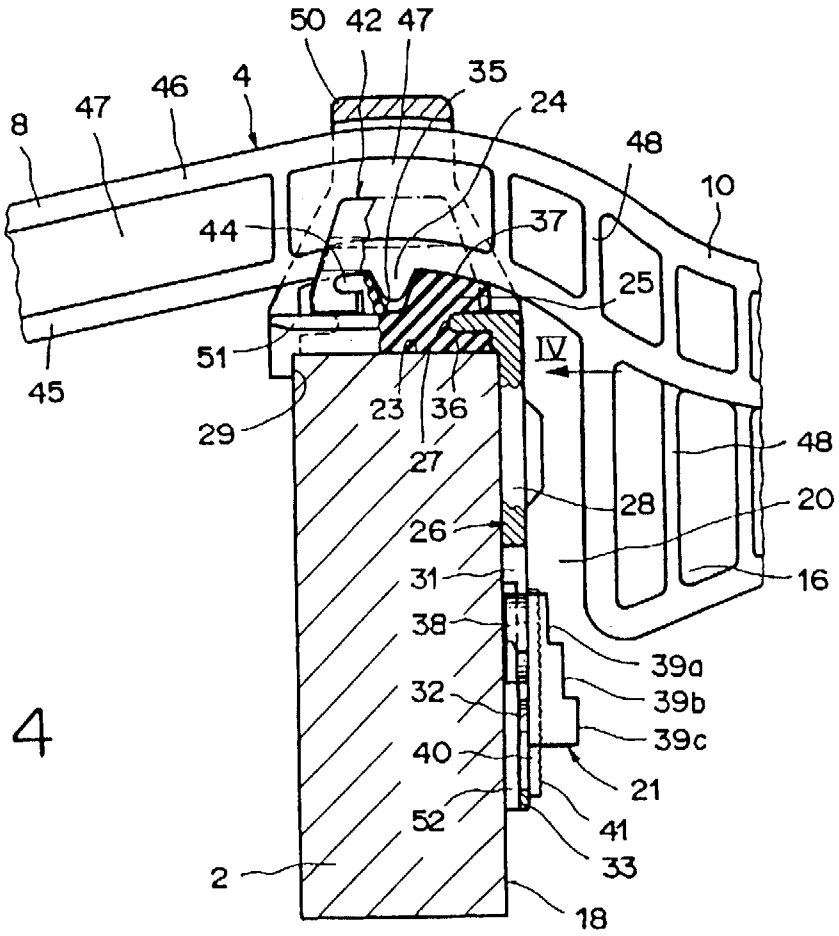
FIG. 3 is an enlarged section of the detail III of FIG. 2, depicting the arrangement of the supporting slat on a longitudinal support.
Figure 4:
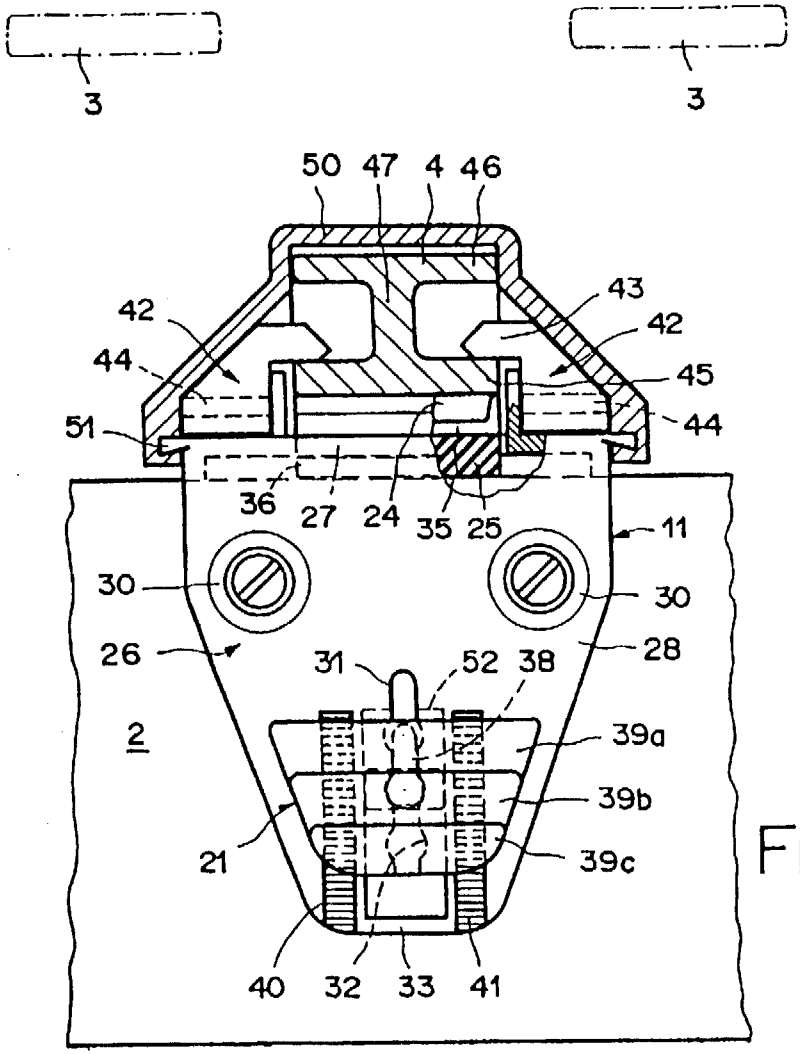
FIG. 4 is a side view of the arrangement in FIG. 3, the supporting slat being cut.
Figure 5:
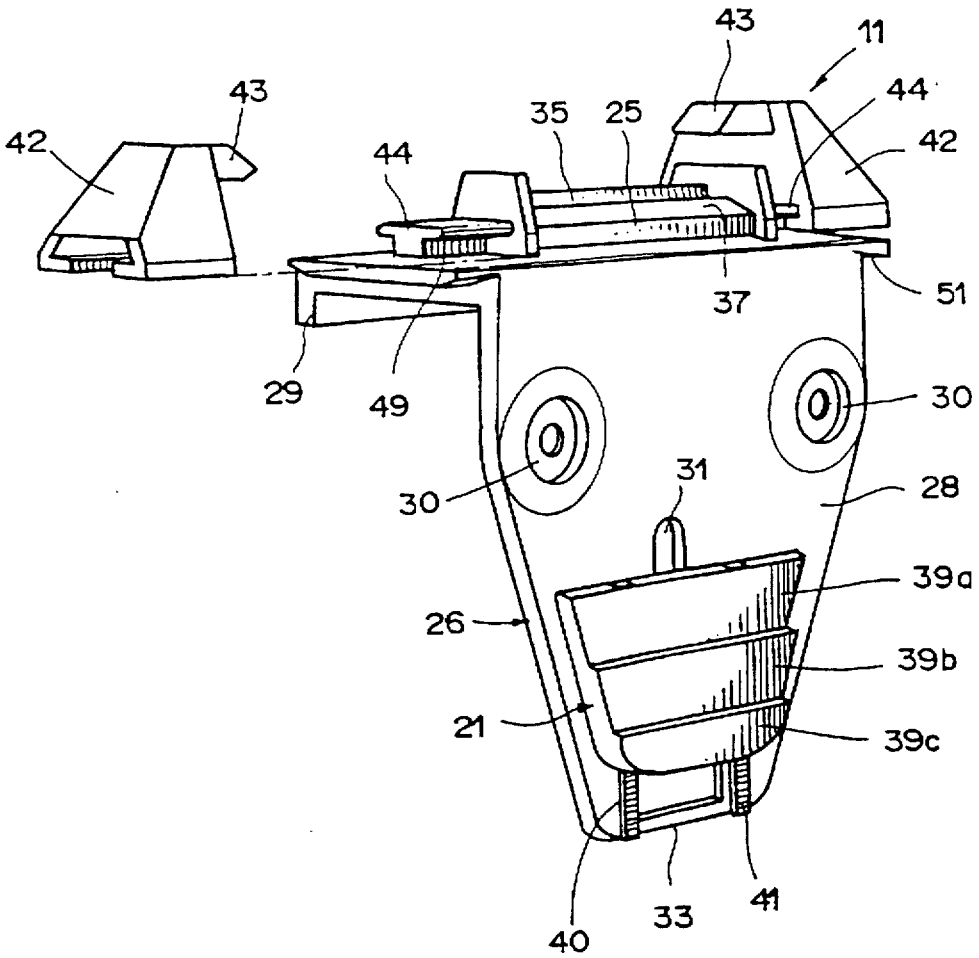
FIG. 5 is a perspectival representation of an element for holding down the supporting slat on a longitudinal support of the slatted base.

Shown enlarged in FIG. 3 is a place of contact of the supporting slat 4 on one of the longitudinal supports 1, 2, in the example shown on the right longitudinal support 2. FIG. 4 shows a view of this place from the direction of the arrow designated IV in FIG. 3. FIG. 5 shows a perspective representation of the holding-down element 11, which plays a central role in connecting the supporting slat 4 to the longitudinal supports 1, 2. FIGS. 3, 4 and 5 will therefore be described together in the following.

In FIG. 3, the right longitudinal support 2 is shown in section. Shown above it is a partial area of the supporting slat 4, said middle area 8 being left of the longitudinal support 2, and the end area 10 of the supporting slat 4 extending to the right of the longitudinal support 2. The supporting slat 4 is constructed in one piece as a plastic injected part in the example shown, and comprises in particular an upper rib 46, extending continuously from supporting slat end to supporting slat end, and a lower rib 45, running essentially parallel thereto and spaced apart therefrom, the two ribs being connected on their entire lengths by means of a central crosspiece 47. The cross-section of the supporting slat 4 is thereby essentially H-shaped. Additional reinforcement ribs 48, running in vertical direction, ensure the necessary stability. In the middle area 8, which is more elastically deformable than the end area 9, 10, there are no reinforcement ribs 48. In the end areas 9, 10, there are many reinforcement ribs 48. The elastic deformability of the end areas 9, 10 is thereby less, compared to the middle area 8. The limiting member 16, visible in FIG. 3, which extends downward on the outer side of the longitudinal support 2, is integrated into the supporting slat 4, manufactured as one piece. Very clearly visible is the interim space 20 between the outer side 18 of the longitudinal support 2 and the stop face, running parallel to the limiting member 16.

A connecting element, or a holding-down element 11, comprises a support 26 on which a support element 25, two hold-down bolts 42, a setting member 21 and a covering cap 50 are located. The support 26 is a part designed essentially U-shaped with a fastening flange 28, which extends on the outer side 18 toward the longitudinal support 2 and a shorter stop limb 29, which extends on the inner side of the longitudinal support 2. Located in the base side, which connects two said limbs together and which extends in the area of the supporting slat 4 over the upper side 22, 23 of the longitudinal support 1, is a preferably rectangular aperture for insertion and holding 27. The support element 25, made of an elastic material such as rubber, silicon or the like, is led and held through this aperture 27. The support element 25 has a plate-shaped layer on the side facing the longitudinal support 2. The side of the support element 25 projecting upward out of the insertion aperture 27 comprises a surface 37, cambered transversely to the longitudinal support 2, in which a notch 35 has been made, running in the longitudinal direction of the longitudinal support 2. The notch 35 is essentially triangular in cross-section. Provided on the supporting slat 4 in the area of the upper sides 22, 23 of the two longitudinal supports 1, 2 is one support projection 24 each, which projects into the notch 35 in the mounted state of the supporting slat 4. The support 26 is screwed onto the longitudinal support 2 by means of screws, which are led through the fastening eyes 30 on the fastening flange 28.

The aim now is to hold down the supporting slat 4, placed on the support element 25. For this purpose the support 26 has one guide piece 44 each in the longitudinal direction of the longitudinal support 1, 2, in each case adjacent to said insertion aperture 27; formed on the guide piece 44 is a dovetailed slip-in guide. Each of the hold-down bolts 42 is slideable over the guide piece 44 along the dovetailed slip-in guide and can be pushed forward against the supporting slat 4. Facing this, each hold-down bolt 42 has a hold-down projection 43, which is slideable over the lower rib 45 of the supporting slat 4, and which thereby holds down the supporting slat 4 on the cambered surface 37 of the support element 25.

Positioned along the dovetailed slip-in guide, both on the guide piece 44 and on the hold-down bolt 42, are catch means 49, which make possible only a stepwise sliding of the hold-down bolt 42 along the guide piece 44 upon provision of a certain sliding force. The catch means 49 serve the purpose of preventing the bolts 42 holding down a supporting slat 4 from being able to remove themselves from their pushed-forward, holding position. The catch means 49 are designed preferably in such a way that the slip on force is less than the retraction force. This can be achieved through a correspondingly shaped toothing.

A covering cap 50 of an elastic material, such as rubber, silicon or the like, extends, essentially in the shape of a truncated pyramid, over the base side of the support 26, the hold-down bolt 42 and the held-down area of the supporting slat 4. The covering cap 50 is held on holding projections 51, which are located on the base side of the support 26, and fulfills, in addition to the task of purely covering, the further task of limiting, relatively gently and noiselessly, the range of spring of extremely elastic spring slats. The covering cap 50 is a stop means for the spring slats 3.

Positioned in the fastening flange 28 of the support 26 is a guiding slot 31, which extends essentially from the free limb end toward the supporting slat 4. Provided along the guiding slot 31 are engagement extensions 32, periodically spaced. The end area of the guiding slot 31 facing the free end of the flange 28 is rectangularly extended, a rectangular opening, which thereby results, serving to introduce a guide piece 38 of the setting member 21 into the guiding slot 31. A crosspiece 33 remaining at the end of the flange 28 serves as end stop so that the setting member 21 cannot be pulled downward out of the guiding slot 31. The guide piece 38 slides along the guiding slot 31 in a recess 52, which has been made in the flange from the surface abutting the outer side 18 of the longitudinal support 2. In addition, two guide ribs 40 for the setting member 21 are provided on the outer side of the flange 28 remote from the outer side 18 of the longitudinal support 2, where ribs are provided with an impeding toothing 41 to prevent the setting member 21, once set, from moving by itself.

The setting member 21 is essentially a plate-shaped creation, which allows itself to be moved along the guiding slot 31 in the interim space 20 between the limiting member 16 and the longitudinal support 2. The interim space 20, or the pivot path of the limiting member, can be thereby limited. It is preferable to design the setting member 21 essentially wedge-shaped, with the pivot path decreasing with increasing advance of the setting member 21 in the interim space 20. An advantageous design of the setting member 21 results when, instead of a wedge shape, a three-step design is chosen with setting steps 39*a*, 39*b* and 39*c* with increasing height of step. The engagement extensions 32 in the guiding slot 31 are then spaced apart from one another in such a way that three defined positions result for the setting member 21. The range of deflection of the edge-area elements 6 of the slatted base can thus be set or reset simply, from large to medium-sized, to small, depending upon the insertion extent of the setting member 21, and can be adjusted to the needs of the person for whom the slatted base is intended. The setting member 21 can be made of an elastic material, such as rubber, silicon or the like, to achieve a limiting of the range of deflection which is not abrupt, but is instead gentle and noiseless.

Figure 6:
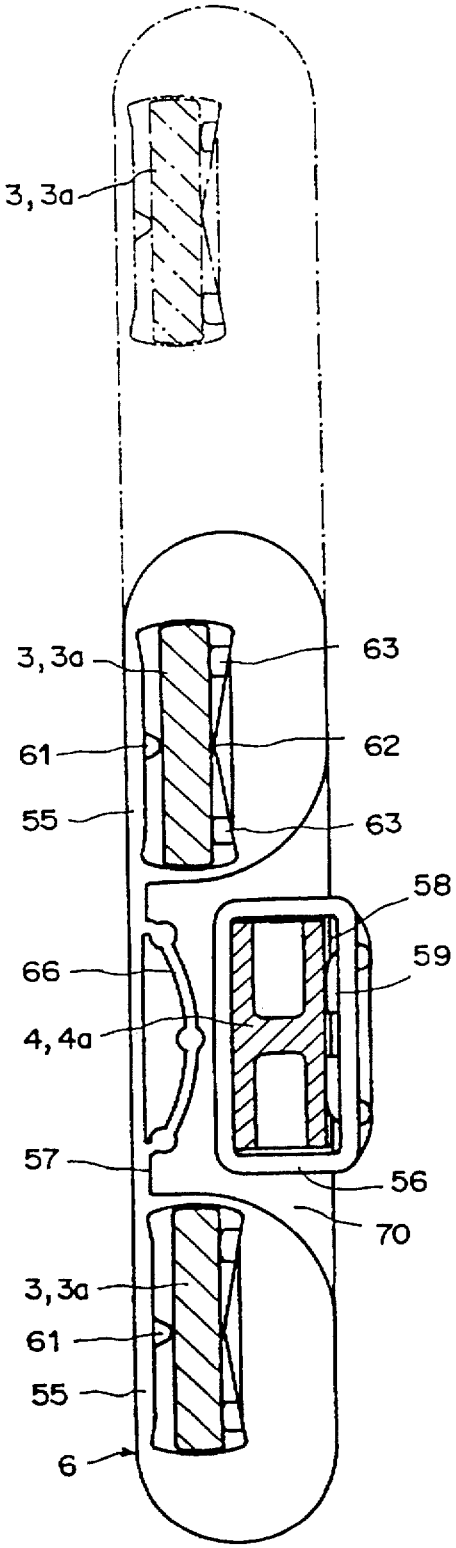
FIG. 6 is a view of a partial section through a bearing module of a slatted base along the line VI—VI in FIG. 1, the arrangement of the various slats in an edge-area element being shown.
Figure 7:
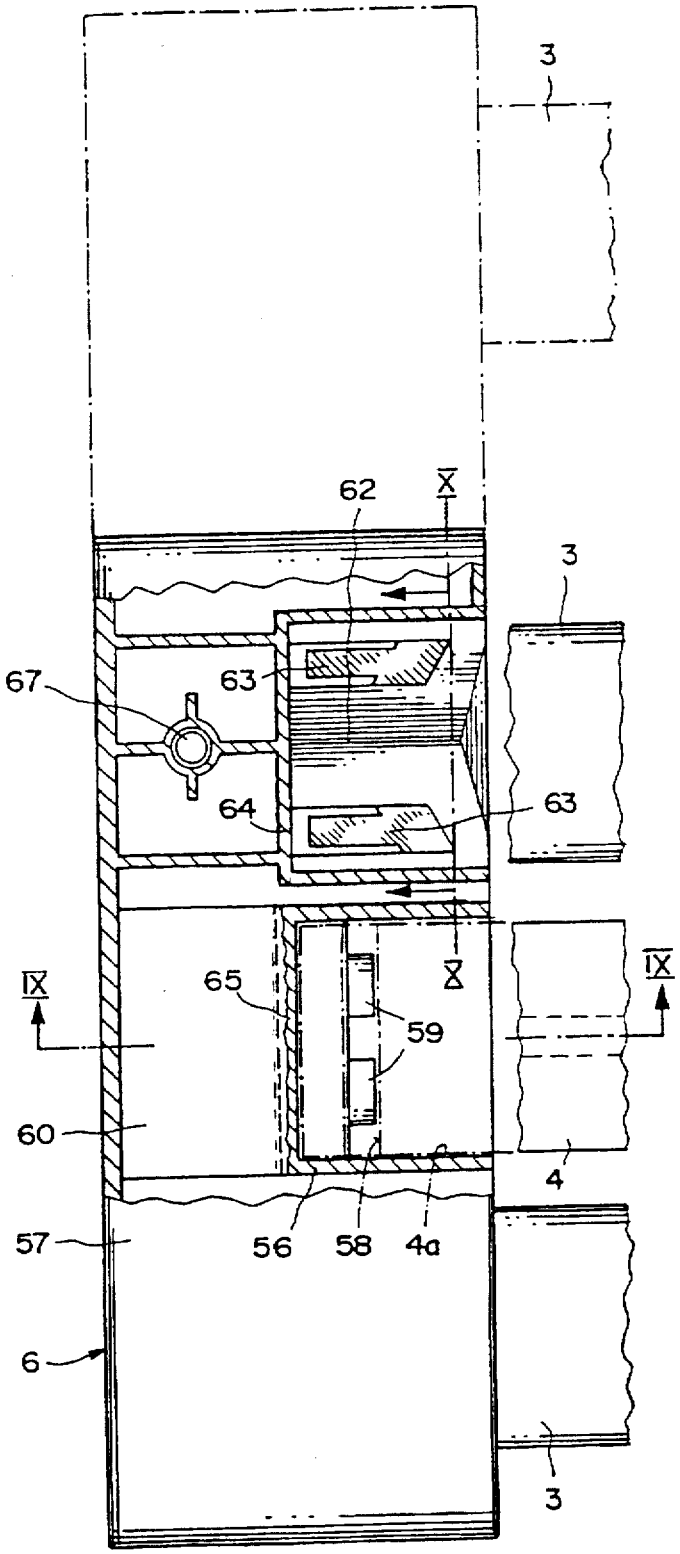
FIG. 7 is a view of the edge-area element according to FIG. 6.

Shown in FIGS. 6 and 7 is an edge-area element 6, with which the lateral ends 3*a*, 4*a* of all spring slats 3 and of the supporting slat 4, which form a bearing module 7, are combined. The edge-area element 6 is designed in such a way that a holding means 56 for the end 4*a* of the supporting slat 4 and one holding means 55 each for the end 3*a* of a spring slat 3 are provided. Preferably combined in an edge-area element 6 are the supporting slat 4 and two spring slats 3, one on either side of the supporting slat 4. The holding means 55, 56 do not overlap thereby in the longitudinal direction of the edge-area element 6, this element having a relatively elongated, but low and slim effect.

The edge-area elements 6, particularly for the head and foot ends of the slatted base, should be designed such that on the one side of the supporting slat 4, i.e. on the side facing the slatted base end, holding means 55 are provided for two spring slats 3. Such a construction of an edge-area element 6 is indicated in dots and dashes in FIGS. 6 and 7.

The holding means 55, 56 for the spring slat 3, respectively for the supporting slat 4, are preferably designed pocket-shaped and completely embrace the end 3*a* of a spring slat 3, respectively the end 4*a* of the supporting slat 4. All holding pockets 55, 56 are connected together tensionally with a bearing element, which is designed as the cover wall 57. The cover wall 57, which encompasses the lateral areas and the upper side of a bearing module 7 in its edge area, is completed with a side wall 70 on the face remote from the slats 3, 4. In this way the edge-area element 6 seems to the viewer as closed toward the outside on all sides.

In the type of slatted base shown, the edge-area element 6 is merely pushed over the ends 3*a*, 4*a* of the spring slats 3 and of the supporting slat 4. It has no connection of any kind with a longitudinal support and a longitudinal groove. Thus it must be ensured that the edge-area element 6 cannot slide laterally by itself. Therefore, at least one holding means 55, 56 and the slat associated thereto with securing means 58, 59, preferably a kind of snap device, by means of which, after slipping the edgearea element 6 on the slat ends 3*a*, 4*a*, a lateral sliding off by itself is no longer possible. The holding means 56 has a first securing means in the form of at least one rib 59, extending transversely to the pocket, projecting into the pocket, and the end 4*a* of the supporting slat 4 has a second securing means in the form of a notch 58, which extends in such a way that, upon insertion of the end 4*a* of the supporting slat 4 into the pocket 56, the rib 59 engages in the notch 58 and thereby prevents a sliding of the edge-area element 6 by itself from the slat ends 3*a*, 4*a*.

A fastening device 67, in the form of an eye, may receive a screw thread of a screw, to which the previously mentioned terminal part 68, for example, can be fastened. The holding pockets 55 for the spring slats 3 have a stop 64. The inserted spring slats 3 extend practically up to the stop 64 in the unloaded state of the slatted base. Upon lifting up the slatted base at the edge-area element 6, the spring slats 3, bent slightly upward, experience a stretching and thus an increase in length. They come to rest thereby on the stop 64 and make impossible any significant deflection upward of the edge-area element 6.

The holding means 56 for the supporting slat 4 likewise has a stop 65. The end of the supporting slat 4 is already held firmly by said securing means 58, 59, however, and a longitudinal shift is prevented.

Shown in FIG. 8 is the edge-area element 6 and the spring slats 3 held therein are pivotable relative to the holding means 56 with the supporting slat 4. A semi-circular shaped pivot stop 66 is positioned between the cover wall 57 and the side of the pocket of the holding means 56 facing this cover wall 57. It is intended to define the aforementioned pivoting movement in that the side of the holding means 56 abutting the pivot stop rolls along the pivot stop 66 during a tilting of the edge-area element 6.

The fastening of the holding means 56 to the cover wall 57, respectively to the side wall 70, is shown in FIG. 9. The holding means 56 is connected to the side wall 70 with a connecting member 60, which can be stressed upon torsion and bending. The connecting element 60 is preferably a relatively thin-walled tongue, which extends between the holding means 56 and the side wall 70. Shown in FIG. 9 is that the tongue, which is relatively elastic, permits the pivoting movement, as shown in FIG. 8. Moreover the longitudinal direction of the holding means 56 relative to the cover wall 57 is also changeable, however, in that the wall 57 can be bent downward in the direction of the arrow 72. Depending on the deflection of the bearing module 7, the relative lengths of the ends 3*a* of the spring slats 3 and of the end 4*a* of the supporting slat 4 can change with respect to one another.

Each holding pocket 55 for one of the ends 3a of a spring slat 3 is designed in such a way that a limited tilting of the spring slat 3 is possible transversely to its longitudinal axis in the holding pocket 55. For this purpose the cross-section of the holding pocket 55 is designed larger than the cross-section of the spring slat end 3*a*. Provided in the holding pocket 55 is an upper projection 61 running in the longitudinal direction of the spring slat 3 and a lower projection 62, which extends in the longitudinal direction of the spring slat 3 and abuts the spring slat end 3*a* essentially in the middle. The lower projection 62 is designed essentially in the form of a V, with a large angle of opening, the two limbs of the V, on the one hand, and the cover wall 57, on the other hand, serving as limitation for the tilting movement of the spring slat 3 inside the holding means 55.

Spring means 63 inside the holding pocket 55 in the form of two flexible tongues, which act upon the spring slat end 3a on each side of the longitudinal axis of a spring slat 3, ensure that, in the unloaded state of the slatted base, the spring slats 3 lie side by side, directed toward each other, in an untilted state.

The edge-area element 6 is preferably made of a thermoplastic material, in one piece, such as an injection-molded part.

The design of the supporting slat 4, its positioning on the longitudinal supports 1, 2, and the design of the edge-area element 6 each contribute to achieving the initially set object.

We claim:

1. A slatted base for a bed, comprising:

a plurality of longitudinal supports, running essentially in a longitudinal direction of the bed, the longitudinal supports being spaced apart from each other;

a plurality of spring slats with mutual spacing to one another, the spring slats running essentially in a transverse direction with respect to the longitudinal supports and collectively forming a supporting surface for a mattress;

at least one elastically deformable supporting slat, situated lower than the spring slats, whereby the supporting slat connects the spring slats with the longitudinal supports, the longitudinal supports being positioned below the spring slats and the outer sides of the longitudinal supports facing ends of the spring slats, the outer sides being set back with respect to the spring slat ends, the supporting slats having an elastically deformable middle area situated between the longitudinal supports, the middle area being more elastic than two end areas;

a plurality of lateral edge-area elements, whereby the edge-area elements combine with at least one spring slat and at least one supporting slat to form a bearing module; and a plurality of connecting elements, which hold the supporting slats on the longitudinal supports, by means of one pivot place of the supporting slats being formed at each holding place in a transverse direction to a corresponding longitudinal support, such that the two lateral edge areas of a bearing module, when loaded at any place, move from the support surface downward.

2. A slatted base according to claim 1, including a limiting member in each end area of each supporting slat, whereby the member serves to limit the deflection of the supporting slat, the limiting member being spaced apart from one side of the more closely situated longitudinal support in an unloaded state of the slatted base, and with a certain loading of, in particular, one of the lateral areas of the slatted base, the one side of the longitudinal support serves as a limit stop for the limiting member.

3. A slatted base according to claim 2, including a setting member, situated in an interim space between the limiting member and the limit stop, the interim space between the limiting member and the limit stop being adjustable as a function of the load.

4. A slatted base according to claim 2, including a setting member, situated in an interim space between the limiting member and the limit stop, the strength of effect of the limiting member on the limit stop being adjustable as a function of the load.

5. A slatted base according to claim 1, including support projections, situated on the supporting slats near the longitudinal supports and turned toward an upper side of the longitudinal supports; and support elements, held between the upper side of the longitudinal supports and the support projections of the supporting slats.

6. A slatted base according to claim 1, including a concave bending of the middle area of the supporting slat, relative to the at least one spring slat, the bending having a curve corresponding approximately to that of a loaded spring slat.

7. A slatted base according to claim 1, including a concave bending of the entire supporting slat, relative to the at least one spring slat, whereby the concave bend is undulating.

8. A slatted base according to claim 1, including straight-running support slat ends of an unmounted, unloaded support slat, having a length of at least two inches.

9. A slatted base according to claim 1, including at least one stop means positioned on each bearing module for soft and silent limiting of the spring range of the spring slats.

10. A slatted base according to claim 1, wherein the supporting slat is manufactured as an injection-molded part.

11. A slatted base according to claim 1, wherein the supporting slat is made of a thermoplastic material.

12. A slatted base according to claim 1, including pocket-shaped holding means of the edge-area elements for one end of the at least one spring slat and for one end of the supporting slat of a bearing module, the holding means being positioned side by side in the longitudinal direction of the longitudinal supports and not overlapping in this direction; and a cover wall, designed as the bearing element and whereby the cover wall spans all holding means of an edge-area element and connects the holding means tensionally with one another.

13. A slatted base according to claim 12, wherein the edge-area elements can be slipped on the ends of the at least one spring slat and of the supporting slat; and securing means on the holding means and on one end associated thereto of one of said slats to prevent a lateral sliding off of the slipped-on edge-area element.

14. A slatted base according to claim 13, wherein the securing means, are designed as a snap device.

15. A slatted base according to claim 12, including a connecting member, which can be stressed upon torsion and bending, and which connects the holding means for the end of the supporting slat with the cover wall.

16. A slatted base according to claim 12, including projections, provided in the holding means whereby the projection may receive a spring slat end, project inwardly, run in the longitudinal direction of the spring slat and point to the middle of the spring slat, the projections being intended to hold the spring slat in the holding means associated thereto tiltable within limits transversely to the longitudinal direction of the spring slat; and spring means, which press on lateral edge areas of the spring slat end and are intended to keep an unloaded spring slat in an untiltable position relative to the holding means.

17. A slatted base according to claim 12, including a stop in each of the holding means for the spring slats or for the supporting slats, all ends of said slats reaching essentially up to the stop in the holding means in an unloaded state of the slatted base.

18. A slatted base according to claim 12, wherein the edge-area elements are designed as one piece.

19. A slatted base according to claim 12, wherein the edge-area elements are made of a thermoplastic material.

20. A slatted base for a bed, comprising:

a plurality of longitudinal supports, running essentially in a longitudinal direction of the bed, the longitudinal supports being spaced apart from each other;

a plurality of spring slats with mutual spacing to one another, the spring slats running essentially in a transverse direction with respect to the longitudinal supports and collectively forming a supporting surface for a mattress;

at least one elastically deformable supporting slat, situated lower than the spring slats, and whereby the supporting slats connect the spring slats with the longitudinal supports, the longitudinal supports being positioned below the spring slats and the outer sides of the longitudinal supports facing ends of the spring slats, the outer sides being set back with respect to the spring slat ends, the supporting slats having an elastically deformable middle area situated between the longitudinal supports, the middle area being more elastic than two end areas;

a plurality of lateral edge-area elements, whereby the edge-area elements combine with at least one spring slat and at least one supporting slat to form a bearing module; and pocket-shaped holding means of the edge-area elements each for one end of the at least one spring slat and for one end of the supporting slat of a bearing module, the holding means being positioned side by side in a longitudinal direction of the longitudinal supports and not overlapping in the longitudinal direction;

a cover wall, designed as the bearing element and whereby the cover wall spans all holding means of an edge-area element and connects the holding means tensionally with one another;

connecting elements, which hold the supporting slats on the two longitudinal supports, by means of one pivot place of the supporting slats being formed at each holding place in a transverse direction to a corresponding longitudinal support, such that the two lateral edge areas of a bearing module, when loaded at any place, move from the support surface downward; and a member in each end area of each supporting slat, whereby the member serves to limit the deflection of the supporting slat, the member being spaced with respect to one side of the more closely situated longitudinal support in an unloaded state of the slatted base, and with a certain loading of, in particular, one of the lateral areas of the slatted base, the one side of the longitudinal support serves as a limit stop for the member.

* * * * *